US005630883A

United States Patent [19]

Steer et al.

[11] Patent Number: 5,630,883

[45] Date of Patent: May 20, 1997

[54] METHOD OF CLEANING DRAINS UTILIZING HALOGEN-CONTAINING OXIDIZING COMPOUND

[75] Inventors: Frank J. Steer; Mark M. Gipp, both of Racine, Wis.

[73] Assignee: S. C. Johnson & Son, Inc., Racine, Wis.

[21] Appl. No.: 393,974

[22] Filed: Feb. 24, 1995

[51] Int. Cl.[6] ..... C23G 3/04; C23G 5/028; B08B 9/02

[52] U.S. Cl. ..... 134/22.13; 134/22.14; 510/195

[58] Field of Search ..... 134/2, 3, 22.13, 134/22.14, 22.16, 22.17, 22.19, 42; 252/300, 174.14, 174.19, 90; 510/195

[56] References Cited

U.S. PATENT DOCUMENTS

| | | | |
|---|---|---|---|
| 3,506,582 | 4/1970 | Gertzman | 252/195 X |
| 3,553,146 | 1/1971 | Butke et al. | 510/195 X |
| 3,968,048 | 7/1976 | Bolan | 252/157 |
| 4,088,596 | 5/1978 | Arai et al. | 252/99 |
| 4,388,204 | 6/1983 | Dimond et al. | 510/295 X |
| 4,522,738 | 6/1985 | Magid et al. | 252/90 |
| 4,540,506 | 9/1985 | Jacobson et al. | 510/195 X |
| 4,619,710 | 10/1986 | Kuenn et al. | 134/22.17 |
| 4,664,836 | 5/1987 | Taylor, Jr. et al. | 252/91 |
| 4,666,625 | 5/1987 | Shaer et al. | 510/195 X |
| 5,011,538 | 4/1991 | Smith | 134/22.13 |
| 5,264,146 | 11/1993 | Tobiason | 252/157 |
| 5,407,595 | 4/1995 | Kamiya | 510/195 X |

*Primary Examiner*—Jill Warden
*Assistant Examiner*—Saeed Chaudhry
*Attorney, Agent, or Firm*—Laura L. Bozek

[57] ABSTRACT

Methods of substantially removing a restriction from a drain pipe system include the steps of introducing a cleaning composition containing a non-caustic drain opening active to the pipe system, activating the cleaning composition by adding a sufficient amount of liquid to the drain pipe system while maintaining a flow-through state through the pipe system, allowing the drain opening active to remain in contact with the restriction for a sufficient time to substantially degrade the restriction, and rinsing the drain opening active from the pipe system. The water flow rate through the pipe system is improved by at least 0.7 liters/minute after 16 hours of the drain opening active contacting the restriction. These methods are effective for both clogged and slow-running drains.

11 Claims, No Drawings

METHOD OF CLEANING DRAINS UTILIZING HALOGEN-CONTAINING OXIDIZING COMPOUND

TECHNICAL FIELD

The present invention is directed generally to an improved method of cleaning drains, and more particularly to a method for substantially removing organic restrictions from a drain utilizing a gas generation/entrapment system.

BACKGROUND ART

Drains in household and commercial use such as restaurants often become clogged or slow running due to the build-up of organic materials and inorganic salts on the drain pipe's interior surfaces. Accordingly, consumers desire a drain cleaning product which is easy to use and reduces the frequency at which drain clogs must be treated.

Traditional liquid drain cleaners are unsatisfactory because the cleaning agents contained in these cleaners only reach the portion of the drain pipe which is in contact with the water carrying the agent. As a result, vertical and horizontal portions of the pipe will receive unequal amounts of cleaning. Thus the drains must be treated more frequently with these traditional liquid cleaners in order to maintain adequate water flow through the pipe.

Thus, there is a need for a cleaning system which would allow the cleaning agents to contact all the interior surfaces of the pipe line. It is also desirable for the cleaning agents to continue to degrade the soil deposits after the carrier system has dissipated, Prior art compositions have attempted to provide these features through effervescent or foaming cleaning compositions. Exemplary of such cleaning compositions are those found in U.S. Pat. Nos. 5,264,146 to Tobiason, 4,664,836 to Taylor, Jr. et al. and 4,619,710 to Kuenn et al. The patents to Tobiason and Taylor, Jr. et al. relate to drain and/or sewer cleaning compositions, while the patent to Kuenn et al. relates to a disposer cleaner. However, these cleaning compositions do not simultaneously provide effective delivery of cleaning agents to the interior surface of the drain pipe and cleaning efficacy. In addition, the most preferred embodiment of Taylor, Jr. et al. utilizes caustic materials as cleaning agents, which are only effective in alkaline pH. Thus these cleaning compositions may not employ alkali sensitive components.

Therefore, it is an object of the present invention to provide a cleaning composition that coats the interior surface of a drain to be treated so that drain opening actives may contact the organic restrictions.

It is a further object of the present invention to provide a method of effectively removing soil deposits over the entire interior surface of a drain pipe thereby reducing the number of times a drain will need to be treated.

Another object of the present invention is to provide a method of cleaning a drain utilizing a cleaning composition which is relatively pH insensitive.

It is an additional object of the present invention to provide a drain cleaning composition which is economical and easy for the consumer to use.

It is a further object of the present invention to provide a drain cleaning composition which can be produced by current manufacturing and filling methods.

BRIEF DESCRIPTION OF THE INVENTION

Unexpectedly, the present invention achieves the above enumerated objectives by providing a method of substantially removing an organic restriction from a drain pipe comprising the steps of:

(a) introducing to a drain pipe with an organic restriction a cleaning composition comprising a gas generation/entrapment carrier and a non-caustic drain opening active, wherein the carrier allows the drain opening active to contact substantially all the interior surfaces of the pipe;

(b) allowing the drain opening active to remain in contact with the organic restriction for a sufficient time to substantially degrade the restriction; and (c) rinsing the cleaning composition and restriction from the pipe, wherein the composition improves the water flow rate through the pipe by at least 0.7 liters/min. after 16 hours of contact.

Advantageously, this method is effective on both slow-running and clogged drain pipes.

BEST MODE FOR CARRYING OUT THE INVENTION

The method of the present invention introduces a cleaning composition to a drain pipe having an organic restriction such as a clog or soil deposits on the interior surfaces of the drain pipe. The cleaning composition is typically in dry form such as granules, powder, cake and tablet. Granular or powder forms are preferred as they may be readily dispensed into a pipe and quickly activated due to their relatively large surface area.

The cleaning composition is activated by the addition of a sufficient amount of water to the composition disposed within the pipe. The order of addition of water and cleaning composition is not critical. The composition evolves gas which is entrapped by a foaming surfactant. The force of the foam produced by this reaction can physically dislodge solid particulate in a drain pipe and carries drain opening actives through the drain pipe. In addition, as the foam travels through the pipe, it effectively reaches all the surfaces of both horizontally and vertically oriented sections of the pipe. Further, as the foam dissipates, the drain opening actives it carries become imbedded in the soil deposits on the surfaces of the drain pipe. The drain opening actives are allowed to remain in contact with the organic restriction to promote a more complete dissolution and removal of soil deposits. Then the cleaning composition and the restriction are rinsed from the drain pipe.

The cleaning composition employed in the method of the present invention generally comprises a gas generation/entrapment system and a non-caustic drain opening active. Non-caustic compositions are those which contain less than 5% by weight of a stoichiometric excess of a highly caustic material such as sodium hydroxide or potassium hydroxide. Non-caustic drain opening actives such as oxidizers are superior to highly caustic materials because they work on a broader spectrum of organic soils and tend to work faster at lower concentrations.

The gas generation/entrapment system is generally capable of generating any type of gas. Preferably the gas generation/entrapment system generates oxygen or carbon dioxide gas. For carbon dioxide systems, the gas generation/entrapment carder generally comprises an alkali carbonate, an acid and a foaming surfactant. Suitable alkali carbonates, include, but are not limited to, sodium and potassium carbonates, such as sodium carbonate, sodium bicarbonate, potassium carbonate, potassium bicarbonate, and mixtures thereof. Typically, the alkali carbonate is present in amounts ranging from about 7% to about 90%; preferably from about 10% to about 50%; and most preferably from about 10% to about 35% by weight. In a preferred embodiment, the alkali carbonate component comprises a mixture of from about 18% to about 28% by weight of sodium carbonate and about 5% by weight of sodium bicarbonate.

The acid component is present in the range of about 2% to about 70%; preferably from about 5% to about 50%; and most preferably from about 10% to about 35% by weight. Suitable acids for use in the present invention include without limitation, citric, sodium citrate, fumaric, adipic, maleic, oxalic, lactic, sulfamic and acid-forming salts such as sodium sulfite, sodium bisulfate and potassium citrate. Citric acid is preferred because of its commercial availability and low cost.

Foaming surfactants that may be employed in the present invention include anionic, nonionic and amphoteric, and mixtures thereof. The surfactant component is present in the range of from less than 1% to about 15%; preferably from about 0.5% to about 10%; and most preferably from about 1% to about 5% by weight of the composition.

Suitable anionic surfactants include alpha olefin sulfonates, the alkyl aryl sulfonic acids and their alkali metal and alkaline earth metal salts such as sodium dodecyl benzene sulfonate, magnesium dodecyl benzene sulfonate, disodium dodecyl benzene disulfonate and the like as well as the alkali metal salts of fatty alcohol esters of sulfuric and sulfonic acids, the alkali salts of alkyl aryl (sulfothioic acid) ethers, alkyl thiosulfuric acid and soaps such as coco or tallow, etc. Preferred anionics include sodium dodecyl benzene sulfonate available under the tradename Nacconal 40-G from Stepan Company, Northfield, Ill.; and sodium lauryl sulfate ("SLS") because of its detergency, wetting, foam enhancing and emulsifying properties. SLS is available in dry form under the trade designation Stepanol ME-Dry from the Stepan Chemical Company.

Suitable nonionic surfactants include the ethylene oxide esters of alkyl phenols such as (nonylphenoxy) polyoxyethylene ether, the ethylene oxide ethers of fatty alcohols such as tridecyl alcohol polyoxyethylene ether, the propylene oxide ethers of fatty alcohols, the ethylene oxide ethers of alkyl mercaptans such as dodecyl mercaptan polyoxyethylene thioester, the ethylene oxide esters of acids such as the lauric ester of methoxy polyethylene glycol, the ethylene oxide ethers of fatty acid amides, the condensation products of ethylene oxide with partial fatty acid esters of sorbitol such as the lauric ester of sorbitan polyethylene glycol ether, and other similar materials.

Suitable amphoteric surfactants include the fatty imidazolines, such as 2-coco-1-hydroxyethyl-1-carboxymethyl-1-hydroxylimidazoline and similar compounds made by reacting monocarboxylic fatty acids having chain lengths of 10 to 24 carbon atoms with 2-hydroxy ethyl ethylene diamine and with monohalo monocarboxylic fatty acids.

An additional class of foaming surfactants are amine oxides which demonstrate cationic surfactant properties in acidic pH and nonionic surfactant properties in alkaline pH. Exemplary amine oxides include dihydroxyethyl cocamine oxide, tallowamidopropylamine oxide and lauramine oxide.

Non-caustic drain opening actives include, but are not limited to oxidizing agents, reducing agents, enzymes, bacteria, and mixtures thereof. Typically, the active is present in amounts from about 0.1% to about 90% by weight of the cleaning composition.

Suitable oxidizing agents include halogen-containing compounds, preferably chlorine containing compounds such as alkali metal and alkaline earth metal hypochlorites, hypochlorite addition products, chloramines, chlorinated isocyanurates, halogenated hydantoins and inorganic hypohalite releasing agents. Examples of halogenated compounds include calcium hypochlorite, sodium dichloro-s-triazinetrione, potassium dichloroisocyanurate, sodium dichloroisocyanurate, 1,3-dibromo and 1,3-dichloro-5-isobutylhydantoin, and p-toluenesulfonchloramide. If employed, halogenated compounds are typically present in amounts from about 10% to about 90%, preferably from about 20% to about 75% and most preferably from about 35% to about 70% by weight of the cleaning composition. Preferably the halogenated compound is sodium dichloroisocyanurate dihydrate available under the tradename CDB-63 from FMC Corp., Philadelphia, Penna.; or calcium hypochlorite available at varying activities under the tradenames HTC and Supersocket from Olin Corp., Stamford, Conn.

Additional oxidizing agents, including peroxygen compounds which produce hydrogen peroxide upon dissolution in water may also be employed in the present invention as the drain opening active. It is preferable to employ a powdered or granular form such as sodium perborate, sodium percarbonate peroxyhydrate, potassium peroxymonosulfate or sodium percarbonate. If utilized, the peroxygen compound is typically present in amounts from about 1% to about 90%, preferably from about 5% to about 75%; and most preferably from 15% to about 65% by weight of the composition.

If an oxidizing agent is used as a drain opening active, oxidizing enhancing agents may also be employed. For example tetraacetylethylenediamine ("TAED") is suitable for enhancing the activity of peroxygen compounds.

Reducing agents which are suitable for use as drain opening actives include sodium thiosulfate, reducing sugars, thiourea, sodium bisulfite, sodium borohydride, hydrazine salts, sodium hypophosphite, aluminum hydride, calcium thioglycolate and sodium thioglycolate.

Preferably the reducing agent is sodium thioglycolate. Reducing agents are typically present in amounts from about 1% to about 90%, preferably from about 5% to about 75%, and most preferably from about 15% to about 65% by weight of the cleaning composition.

Suitable enzymes for use in the present invention include, for example, protease, amylase, cellulase, lipase and mixtures thereof. Preferably the enzyme is a mixture of the above listed enzymes available under the tradename Otimase from Novo Nordisk Bioindustrials Inc., Danbury, Conn. Enzymes, in commercially available forms, are typically present in amounts from about 0.1% to about 50%, preferably from about 0.1% to about 10%, and most preferably from about 1% to about 5% by weight of the cleaning composition.

If bacteria is used as the drain opening active, it is typically present in a commercially available form in amounts from about 0.1% to about 50%, preferably from about 0.1% to about 20%, and most preferably from about 1% to about 10% by weight of the cleaning composition. Suitable bacteria are those which are specially developed for waste and sewer treatment.

Other ingredients may be added to the cleaning composition such as coloring agents and fragrances. Generally the coloring agent is present in any amount less than about I% by weight of the cleaning composition. Fragrances that may be used are any suitable acid or base stabilized fragrance which will leave the drain with a pleasant scent after treatment with the cleaning composition. The fragrance component is typically present in an amount of less than about 1% by weight of the cleaning composition.

Additional optional components include corrosion inhibitors, anticaking agents, tableting aids, solubility control agents, disinfectants, desiccants and the like. If utilized, these components are typically present from about 0.5% to about 1.0% by weight of the cleaning composition.

Abrasive particles may also be added to the composition to assist in physical cleaning. Suitable abrasives include pumice, silica sand, quartz, calcium carbonate and diatomaceous earth in the 0.1–250 μm particle size range. Typically abrasives are present in amounts from about 0 to about 2% by weight of the cleaning composition.

The cleaning composition may be prepared using any of the methods known in the art involving the formation of granular or powder cleaning compositions such as spray drying, and agglomeration methods such as those used to produce granular dishwashing or laundry detergents, or tableting, encapsulation and extrusion methods such as those to produce lavatory cleansing blocks. Preferably the cleaning composition is prepared by dry blending the ingredients. It has been found that high humidity in the manufacturing environment may reduce the shelf-life of the cleaning composition. Accordingly, care must be taken to avoid contamination of the composition, or alternatively, the components may be maintained in separate packaging.

The invention will be further described by reference to the following detailed examples.

Example 1: Hair Dissolution Test

One of ordinary skill in the art will appreciate that it is difficult to replicate clogged or slow drains in the laboratory. Accordingly, a test which is relatively easy to reproduce in a laboratory was designed to determine the effectiveness of cleaning compositions on a common organic restriction such as hair. An experiment was performed testing the effectiveness of a preferred embodiment of the drain opening composition of the present invention against hair clogs. In this experiment, 5.0 g of human hair was inserted into the bottom of a large graduated cylinder. About 500 g of warm water (about 38° C.) followed by 45.0 g of the composition in Table A was added to a large graduated cylinder. After approximately 16 hours, the contents of the cylinder were rinsed out with water and collected. The hair was dried in an oven at about 49° C. for approximately 8 hours. As a control, 5.0 g of untreated hair was also dried under the same conditions. The control sample lost about 0.24 g (±0.01 g) of hair, presumably due to moisture loss. The cleaning composition employed in the method of the present invention dissolved 3.08 g of hair.

TABLE A

| Granular Drain Cleaner | |
|---|---|
| Ingredient | Wt. % |
| CDB-63 Sodium Dichloro-isocyanurate | 45.00 |
| Citric Acid USP Fine Granular | 19.50 |
| Sodium Carbonate Anhydrous Dense Grade | 27.50 |
| Sodium Dodecylbenzene Sulfonate Nacconol 40-G | 3.00 |
| Sodium Bicarbonate USP Coarse #5 | 5.00 |
| | 100.00 |

45.0 g of a sewage and drain line cleaning composition containing 10% by weight of caustic soda as the active described in column 2 of U.S. Pat. No. 5,264,146 to Tobiason was also tested with the hair dissolution procedure described above. The hair loss for the Tobiason composition was 0.26 g.

The same procedure was used for 45.0 g of the disposer cleaning composition described in Example 6 of U.S. Pat. No. 4,619,710 to Kuenn et al. The hair loss for this composition after oven drying was 0.23 g.

45.0 g of a most preferred embodiment of the drain cleaning composition in col. 7 of U.S. Pat. No. 4,664,836 to Taylor, Jr. et al. was also tested by the above-described hair dissolution method. The sodium hydroxide of the '836 composition was not coated with $C_{12}$–$C_{14}$ fatty acid monoethanolamide, as there was no need for long-term stability of the '836 formula. Instead both components were mixed with the remaining ingredients. The pigment was not added to the '836 composition. The hair loss for this composition was 5.0g.

Example 2: Gas Generation/Entrapment Test

It has been observed by those of skill in the art that cleaning compositions which achieve a foam volume of less than 250 ml do not provide sufficient coverage of the interior surfaces of a drain pipe to effectively distribute drain opening agents. Thus, experiments were also performed to demonstrate the surface area of drain pipe which could be contacted by the cleaning compositions using equivalent volumes of the cleaning compositions tested in Example 1. This was accomplished by testing the initial foam volume produced by the cleaning compositions. About 500 g of warm water (about 38° C.) followed by 45.0 g of the composition in Table A was added to a large graduated cylinder. The total foam volume was measured at its maximum height in the cylinder. The cleaning composition of the present invention achieved a foam volume of 1021.6 ml.

45.0 g of a sewage and drain line cleaning composition containing 10% by weight of caustic soda as described in column 2 of U.S. Pat. No. 5,264, 146 to Tobiason was also tested with the gas generation/entrapment procedure. The '146 composition produced a foam volume of 1045.3 ml.

A drain cleaning composition as described in Example 6 of U.S. Pat. No. 4,619,710 to Kuenn et al. was also tested with the gas generator/entrapment method as described above. The foam volume exceeded 3300 ml, the maximum volume of the cylinder used for the testing procedure.

45.0 g of a most preferred embodiment of the drain cleaning composition in col. 7 of U.S. Pat. No. 4,664,836 to Taylor, Jr. et at. was also tested by the above-described gas generation/entrapment method. The sodium hydroxide of the '836 composition was not coated with $C_{12}$–$C_{14}$ fatty acid monoethanolamide, as there was no need for long-term stability of the '836 formula. Instead both components were mixed with the remaining ingredients. The pigment was not added to the '836 composition. The composition achieved a foam volume of 831.5 ml.

As demonstrated by the results of both the hair dissolution and gas generation/entrapment tests above, equivalent volumes of a cleaning composition of the present invention achieved both cleaning efficacy and potential surface area coverage without the use of caustic drain opening actives.

Example 3: In-Home Testing

It has also been observed by those of skill in the art that a cleaning composition should improve the water flow by an average of at least 0.7 liters/min. after 16 hours of contact to be considered effective on household drains. Accordingly, in-home testing was performed on a statistically representative number of drains which consumers considered "slow-running" to demonstrate the effectiveness of a preferred embodiment of the present invention. The test was performed by adding 45.0 g of the formulation of Table A to the drain pipe followed by about 500 g of warm water. The cleaning composition was allowed to remain in the drain pipe for about 16 hours. The drain pipe was then rinsed with water. Pre- and post-treatment water flow rate measurements through the drain pipe were conducted by timing a 1 gallon (3.785 liter) water sample through the treated section of the drain pipe. The post-treatment improvement in the water flow of these drain pipes averaged 1.9 liter/min.

Industrial Applicability

The method of the present invention may be readily utilized for improving the water flow in slow-running and clogged drain pipes in both household and commercial settings. In addition, the cleaning compositions employed may be manufactured using currently known production and filling techniques and equipment for granular or powdered cleaning compositions.

Other modifications and variations of the present invention will become apparent to those skilled in the art from an examination of the above specification. Therefore, other variations of the present invention may be made which fall within the scope of the appended Claims even though such variations were not specifically discussed above.

What is claimed is:

1. A method of substantially removing a restriction from a drain pipe system comprising the steps of:

introducing to a drain pipe system having an organic restriction a dry cleaning composition comprising a gas generation/entrapment carrier and a non-caustic drain opening active comprising at least one halogen-containing oxidizing compound in an amount from about 10% to about 90% by weight of cleaning composition;

activating the cleaning composition by adding a sufficient amount of water to the drain pipe system while maintaining a flow-through state in the pipe system;

allowing the drain opening active to remain in contact with the restriction for a sufficient time to substantially degrade the restriction; and rinsing the drain opening active and restriction from the pipe system, wherein the restriction removing method improves the water flow rate of the pipe system by an average of at least 0.7 liters/min. after 16 hours of the drain opening active contacting the restriction.

2. The method of substantially removing a restriction as claimed in claim 1, wherein the amount of halogen-containing compound is from about 20% to about 75% by weight of cleaning composition.

3. The method of substantially removing a restriction as claimed in claim 1, wherein the amount of halogen-containing compound is from about 35% to about 70% by weight of cleaning composition.

4. The method of substantially removing a restriction as claimed in claim 1, wherein the halogen-containing compound is selected from the group consisting of calcium hypochlorite, alkali earth metal hypochlorites, alkaline earth metal hypochlorites, sodium dichloro-striazinetrione, chlorinated isocyanurates, 1,3-dibromo and 1,3-dichloro-5-isobutylhydantoin.

5. The method of substantially removing a restriction as claimed in claim 1, wherein the cleaning composition achieves an initial foam volume of at least 250 ml without mechanical generation of foam.

6. The method of substantially removing a restriction as claimed in claim 1, wherein the cleaning composition comprises a foaming surfactant in an amount from about 0.5% to about 10% by weight of cleaning composition.

7. The method of substantially removing a restriction as claimed in claim 6, wherein the cleaning composition further comprises an alkali carbonate in an amount from about 7% to about 90% by weight of cleaning composition and an acid in an amount from about 2% to about 70% by weight of cleaning composition.

8. The method of substantially removing a restriction as claimed in claim 7, wherein the alkali carbonate is selected from the group consisting of sodium carbonate, sodium bicarbonate, potassium carbonate, and mixtures thereof.

9. The method of substantially removing a restriction as claimed in claim 7, wherein the alkali carbonate is a mixture of from about 10% to about 28% by weight of sodium carbonate and about 5% by weight of sodium bicarbonate.

10. The method of substantially removing a restriction as claimed in claim 7, wherein the acid is selected from the group consisting of citric, sodium citrate, fumaric, adipic, maleic, oxalic, lactic, sulfamic, sodium sulfite, sodium bisulfite and potassium citrate.

11. The method of substantially removing a restriction as claimed in claim 6, wherein the surfactant is an anionic surfactant selected from the group consisting of sodium lauryl sulfate, alkyl aryl sulfonic acid, alkali metal salts of alkyl aryl sulfonic acid, alkaline earth metal salts of alkyl aryl sulfonic acid, and mixtures thereof.

* * * * *